US012685392B1

(12) United States Patent
Chen

(10) Patent No.: US 12,685,392 B1
(45) Date of Patent: Jul. 21, 2026

(54) NON-SLIP PLASTIC CHAIR AND NON-SLIP DETECTION DEVICE THEREFOR

(71) Applicant: YONGKANG BEIQIN INDUSTRY & TRADE CO., LTD, Jinhua (CN)

(72) Inventor: Jinfei Chen, Jinhua (CN)

(73) Assignee: YONGKANG BEIQIN INDUSTRY & TRADE CO., LTD, Jinhua (CN)

( * ) Notice: Subject to any disclaimer, the term of this patent is extended or adjusted under 35 U.S.C. 154(b) by 0 days.

(21) Appl. No.: 19/306,333

(22) Filed: Aug. 21, 2025

(30) Foreign Application Priority Data

Jul. 11, 2025 (CN) ..... 202510957367.0

(51) Int. Cl.

| | |
|---|---|
| ***A47C 3/40*** | (2006.01) |
| ***A47B 91/08*** | (2006.01) |
| ***A47C 3/18*** | (2006.01) |
| ***A47C 5/12*** | (2006.01) |

(52) U.S. Cl.
CPC ..... *A47B 91/08* (2013.01); *A47C 3/18* (2013.01); *A47C 3/40* (2013.01); *A47C 5/12* (2013.01)

(58) Field of Classification Search
CPC .... A47C 3/18; A47C 3/40; A47C 5/12; A47B 91/08
See application file for complete search history.

(56) References Cited

U.S. PATENT DOCUMENTS 4,776,046 A * 10/1988 Newberry ..... E04H 4/065 4/546
5,423,466 A * 6/1995 Moon ..... B60R 9/12 248/205.8
5,454,540 A * 10/1995 McPherson ..... A47B 91/00 248/205.8
7,121,620 B1 * 10/2006 Fang ..... A47K 3/122 297/51
9,138,063 B1 * 9/2015 Newman ..... A47C 15/008
10,300,864 B2 * 5/2019 Goddert ..... B60R 9/058
10,736,470 B2 * 8/2020 Preece ..... A47C 13/005
2007/0046077 A1 * 3/2007 Fang ..... A47C 4/03 297/130
2008/0061199 A1 * 3/2008 Chen ..... F16M 11/2064 248/205.8
2022/0322827 A1 * 10/2022 Chien ..... A47B 91/08
2022/0378253 A1 * 12/2022 Williams ..... A47C 11/005

FOREIGN PATENT DOCUMENTS

| | | |
|---|---|---|
| CN | 218784325 U | 4/2023 |
| CN | 219266057 U | 6/2023 |
| CN | 116539336 A | 8/2023 |

* cited by examiner

*Primary Examiner* — Philip F Gabler
(74) *Attorney, Agent, or Firm* — JEEN IP LAW, LLC

(57) ABSTRACT

Relates to the technical field of plastic chairs, providing a non-slip plastic chair and detection device. The chair includes a chair cover and a base plate. The chair cover is movably connected to the base plate. At least two chair legs are disposed at the bottom of the base plate. A leg pad is mounted at the bottom of each chair leg and sleeved on it. A non-slip member is disposed in the leg pad. An upper rotary table is mounted in the chair cover. A lower rotary table is mounted in the base plate. The upper rotary table is rotatably connected to the lower rotary table via balls, enabling the chair to rotate as a whole, improving experience. The balls enable rolling friction between the upper rotary table and it, supporting the chair cover and its load, while greatly reducing friction between the rotary tables, lowering rotation noise.

5 Claims, 9 Drawing Sheets

NON-SLIP PLASTIC CHAIR AND NON-SLIP DETECTION DEVICE THEREFOR

CROSS-REFERENCE TO RELATED APPLICATIONS

The application claims priority to Chinese patent application No. 202510957367.0, filed on Jul. 11, 2025, the entire contents of which are incorporated herein by reference.

TECHNICAL FIELD

The present disclosure relates to the technical field of plastic chairs, and specifically, to a non-slip plastic chair and a non-slip detection device therefor.

BACKGROUND

The non-slip plastic chair is a plastic chair that features non-slip functions in design and material. It is typically made from special plastic materials, and its surface undergoes special processing to increase the coefficient of friction, thereby effectively preventing users from slipping when sitting down, standing up, or moving the chair, and improving safety and stability during use.

Currently, most non-slip plastic chairs are used in bathrooms. During use, when users lean forward or backward, increasing friction through materials alone cannot address the issue, and the plastic chair can still tip over. Moreover, the bathroom surfaces are smooth, and ordinary materials offer only a slight increase in friction, thereby failing to prevent the chair from sliding.

There are also rotary non-slip plastic chairs. In the current rotation method, two pressure plates are used to achieve sliding friction type rotation. The frictional force generated by sliding friction is large, which leads to high wear and tear. This greatly shortens the service life of the chair. In addition, the sliding friction also produces a certain amount of noise.

When non-slip plastic chairs leave the factory, their non-slip performance needs to be tested. Currently, pressure is directly applied to the chair to detect frictional force. This only simulates the pressure generated when a user sits upright. However, when the user leans forward or backward, the center of gravity shifts, so the main pressure applied to the chair remains unchanged, and the pressure exerted by each leg pad at the bottom of the chair changes, which leads to different frictional forces, thereby making it impossible to effectively detect pressure changes under these conditions.

SUMMARY

To solve the above problems in the prior art, the present disclosure provides a non-slip plastic chair and a non-slip detection device therefor. The non-slip plastic chair has the advantages of better safety and stability in bathroom environments.

To achieve the above objective, the present disclosure provides the following technical solutions: a non-slip plastic chair, including a chair cover and a base plate, where the chair cover is movably connected to the base plate, at least two chair legs are disposed at the bottom of the base plate, and a leg pad is mounted at the bottom of each of the chair legs;

the leg pad is sleeved on the chair leg, and a non-slip member is disposed in the leg pad; and an upper rotary table is mounted in the chair cover, a lower rotary table is mounted in the base plate, and the upper rotary table is rotatably connected to the lower rotary table via balls.

Preferably, two symmetrical support tubes are mounted on the chair cover, the support tubes are arranged in an L shape, one part of each of the support tubes is fixedly mounted on the upper rotary table, and the other part of the support tube is mounted with a backrest.

Preferably, the chair legs are fixed to the bottom of the base plate, each of the chair legs includes a main support leg and an auxiliary support leg which are telescopically connected to each other, and the leg pad is sleeved on the auxiliary support leg.

Preferably, the bottom of the leg pad is configured as a flat surface, and a non-slip pad is disposed at the flat surface and made of rubber.

Preferably, a movable friction pad capable of sliding is further disposed at the bottom of the leg pad, an auxiliary plate is rotatably connected in the movable friction pad and is connected in the leg pad via an abutting spring, a suction cup is further fixed in the middle of the leg pad, the movable friction pad slides on the suction cup, and a snap ring is further disposed on an outer peripheral side of the movable friction pad and rotates in the leg pad.

Preferably, inner grooves and limiting grooves are formed on the outer peripheral side of the movable friction pad, at least two limiting blocks and shifting plates are disposed on arc surfaces on two sides of the snap ring, the shifting plates are located outside the leg pad, and the limiting blocks are located in the inner grooves; and a protective groove is formed in the middle of the movable friction pad, a part of the bottom of the suction cup is configured as a circular truncated cone, the circular truncated cone part is located in the protective groove, and a balance hole is further formed in the suction cup.

A non-slip detection device for a non-slip plastic chair, including a detection base and a support disc, where a shifting assembly is disposed in the detection base, and a pressure assembly is disposed on the support disc;

the shifting assembly includes a detection sliding block and a pressure plate, the pressure plate is mounted in the detection sliding block via a detection spring, and the detection sliding block is slidably connected in the detection base; and the pressure assembly includes a pressure plate and electric cylinders, where the pressure plate is mounted on the support disc via a limiting ball, and there are at least two electric cylinders mounted at edges of the support disc respectively.

Preferably, a gear is rotatably connected to the bottom of the detection base and meshes with the detection sliding block, a motor is connected to the gear, several rotating roller shafts are disposed at the bottom of the detection sliding block, and the pressure plate abuts against the roller shafts.

Preferably, the support disc is mounted on the detection base via a telescopic plate, there are four electric cylinders located at four edges of the pressure plate, and four clamping posts are further movably disposed at the bottom of the pressure plate.

Preferably, the limiting ball is configured as a spherical body, two sides of each of the electric cylinders are connected to the support disc and the pressure plate via the spherical body, an operating platform is disposed on an edge of one side of the detection base, and a control module is disposed on the operating platform.

Compared with the prior art, the non-slip plastic chair and the non-slip detection device therefor provided in the present disclosure have the following beneficial effects:

1. According to the non-slip plastic chair and the non-slip detection device therefor, through the arrangement of the upper and lower rotary tables, the chair is rotatable as a whole, which can improve user experience. The balls enable rolling friction between the upper rotary table and a backrest, which not only serves to support the chair cover and a heavy object thereon, but also can greatly reduce a frictional force between the upper and lower rotary tables, thereby lowering noise generated when the chair rotates.

2. According to the non-slip plastic chair and the non-slip detection device therefor, through the arrangement of the suction cups and the movable friction pads, the suction cups expel internal air under chair pressure to form a negative pressure state, such that the leg pads can adhere tightly to the smooth ground, thereby enhancing chair stability, and reducing the risk of falling when a user is in an inclined state such as leaning forward or lying back.

3. According to the non-slip plastic chair and the non-slip detection device therefor, through the arrangement of the pressure assembly and the shifting assembly, frictional forces of the chair in different pressure states can be detected. That is, if only the electric cylinder on the right side is activated, the two corresponding clamping posts exert a high pressure on the chair, while the other three sides of the chair are subjected to a low pressure. In this case, the pressure applied to the chair when the body of the user sitting on the chair leans can be simulated. The detection base detects and records the pressure for comparison with individual detection results from the other three sides. In this way, multi-directional and multi-state detection can be performed on the chair, and frictional forces of the chair in different usage environments can be measured, thereby making performance detection of the chair more comprehensive.

Figure 1:
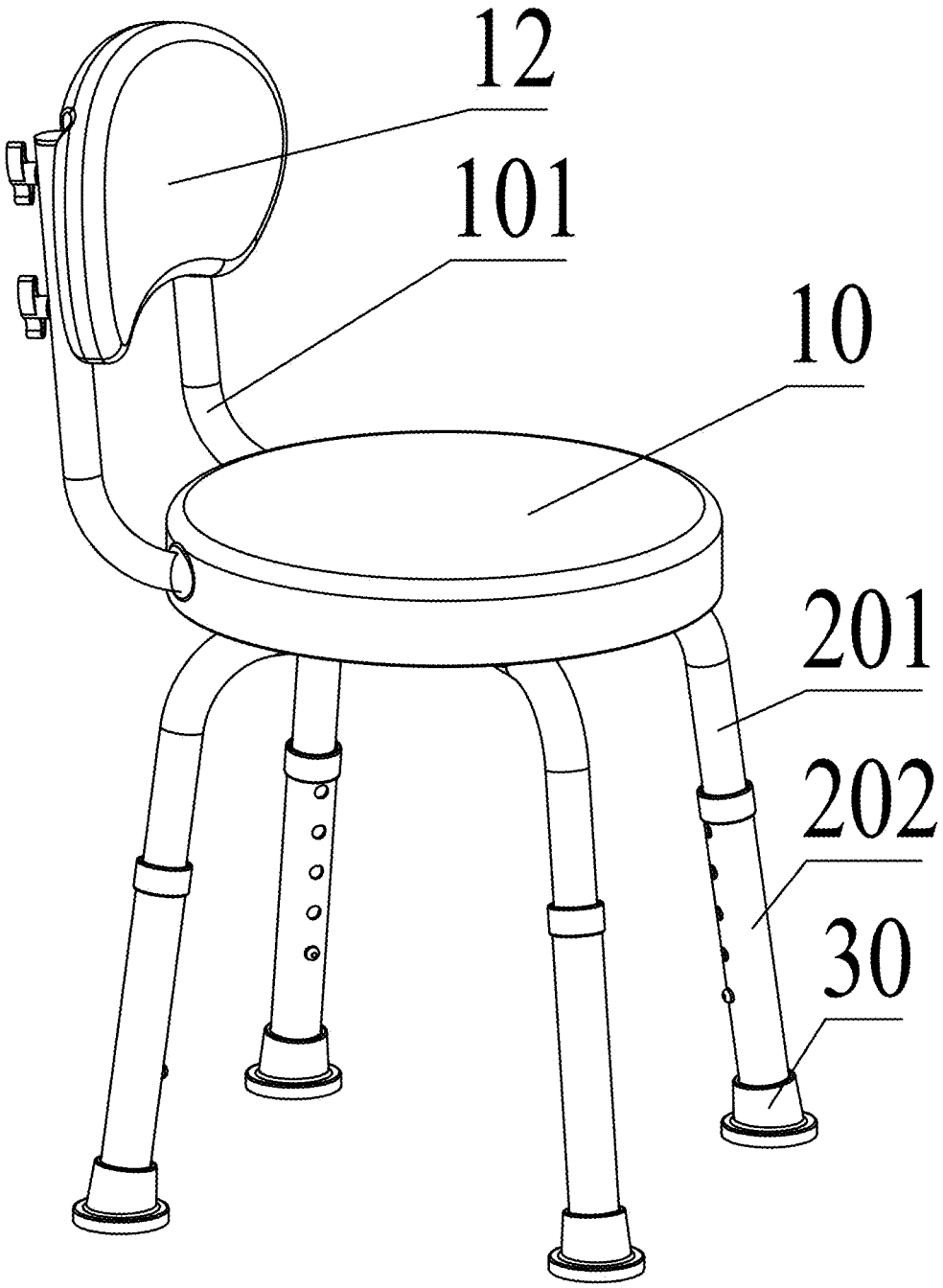
FIG. 1 is a schematic structural diagram of a chair in the present disclosure.

In the drawings: 10: chair cover; 101: support tube; 11: upper rotary table; 12: backrest; 20: base plate; 201: main support leg; 202: auxiliary support leg; 21: lower rotary table; 30: leg pad; 301: movable friction pad; 3011: inner groove; 3012: limiting groove; 302: snap ring; 3021: limiting block; 3022: shifting plate; 303: auxiliary plate; 304: suction cup; 3041: balance hole; 305: protective groove; 40: detection base; 401: detection sliding block; 402: roller shaft; 403: detection spring; 41: pressure plate; 42: gear; 43: operating platform; 50: support disc; 501: electric cylinder; 51: pressure plate; 511: clamping post; 512: limiting ball; and 52: telescopic plate.

DETAILED DESCRIPTION OF THE EMBODIMENTS

The technical solutions in the embodiments of the present disclosure will be clearly and completely described below with reference to the accompanying drawings in the embodiments of the present disclosure. Apparently, the described embodiments are merely some rather than all of the embodiments of the present disclosure. All other embodiments obtained by those of ordinary skill in the art based on the embodiments in the present disclosure without creative efforts shall fall within the scope of protection of the present disclosure.

Embodiment 1

Figure 2:
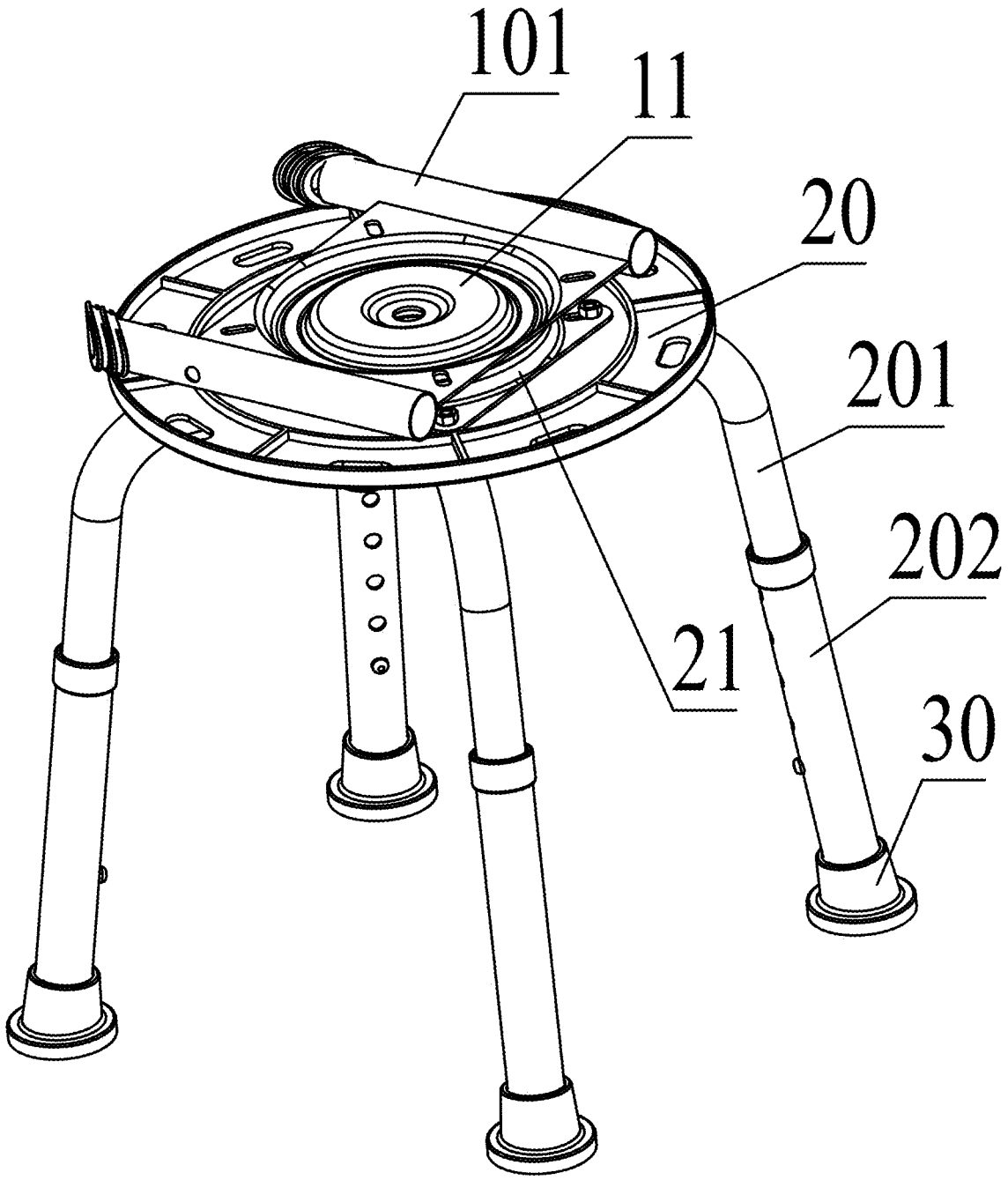
FIG. 2 is a schematic diagram of an internal structure of a chair in the present disclosure.
Figure 3:
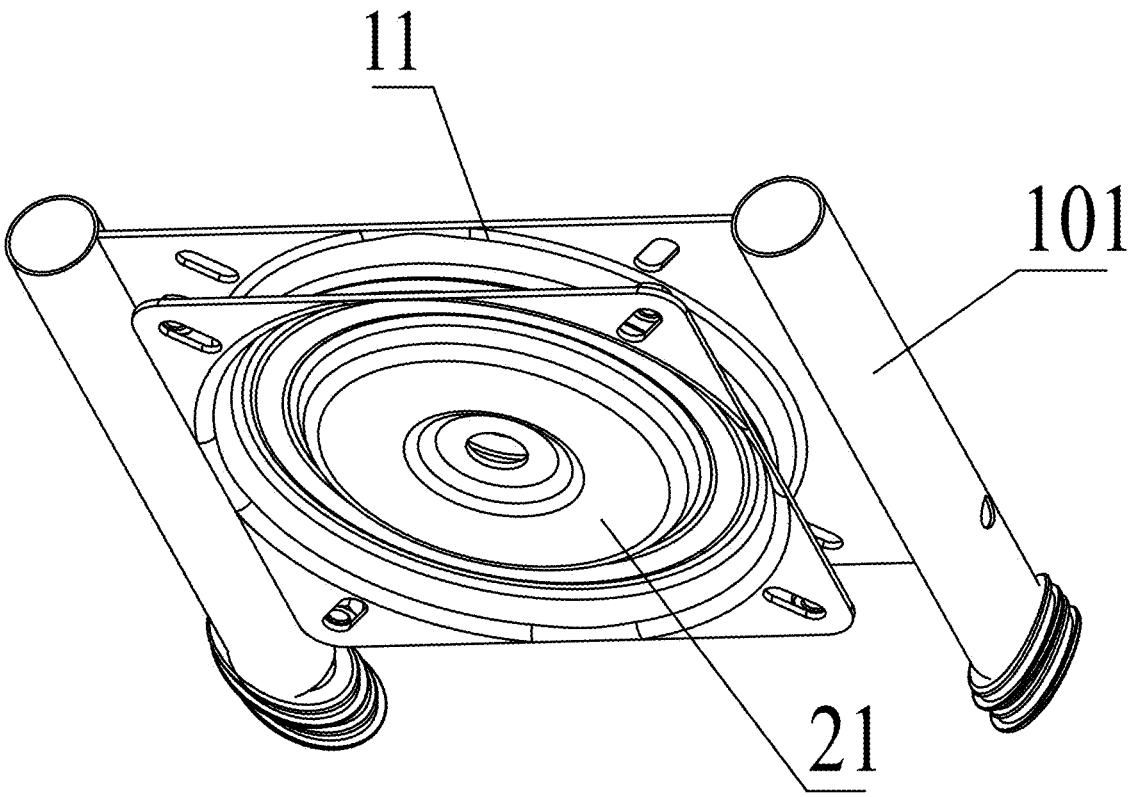
FIG. 3 is a schematic diagram of a rotational structure of a chair in the present disclosure.

As shown in FIGS. 1 to 3, a non-slip plastic chair includes a chair cover 10 and a base plate 20, where the chair cover 10 is movably connected to the base plate 20, an upper rotary table 11 is mounted in the chair cover 10, a lower rotary table 21 is mounted in the base plate 20, and the upper rotary table 11 is rotatably connected to the lower rotary table 21 via balls. Through the arrangement of the upper rotary table 11 and the lower rotary table 21, the chair is rotatable as a whole, which can improve user experience. The balls enable rolling friction between the upper rotary table 11 and a backrest 12, which not only serves to support the chair cover 10 and a heavy object thereon, but also can greatly reduce a frictional force between the upper rotary table 11 and the lower rotary table 21, thereby lowering noise generated when the chair rotates. Two symmetrical support tubes 101 are mounted on the chair cover 10, the support tubes 101 are arranged in an L shape, one part of each of the support tubes 101 is fixedly mounted on the upper rotary table 11, and the other part of the support tube 101 is mounted with the backrest 12. The two parts of the support tube can be detached from each other. Through detachable mounting of the support tubes 101, the backrest 12 and the corresponding parts of the support tubes 101 can be detached when there is no need for the backrest 12, such that the chair is deformed to form a stool, thereby providing multiple choices for a user.

At least two chair legs are disposed at the bottom of the base plate 20, a leg pad 30 is mounted at the bottom of each of the chair legs, and the chair leg includes a main support leg 201 and an auxiliary support leg 202 which are telescopically connected to each other, such that the chair can be adjusted in height to adapt to different groups of people. The leg pad 30 is sleeved on the auxiliary support leg 202, a non-slip member is disposed in the leg pad 30, the bottom of the leg pad 30 is configured as a flat surface, and a non-slip pad is disposed at the flat surface and made of rubber. Through the arrangement of the non-slip pads, a frictional force of the chair can be increased to effectively prevent the chair from sliding when used in a bathroom.

Embodiment 2

Figure 4:
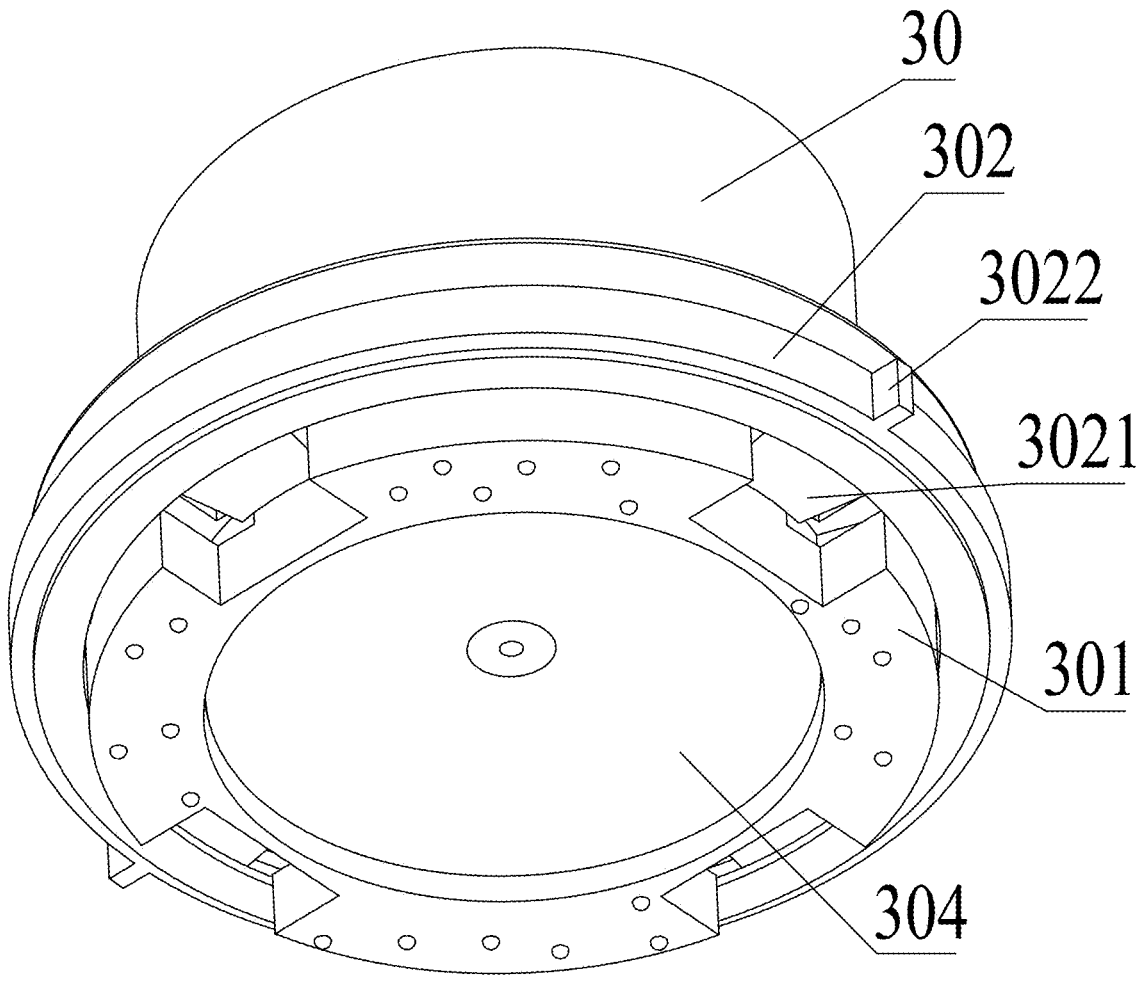
FIG. 4 is a schematic structural diagram of a leg pad in the present disclosure.
Figure 5:
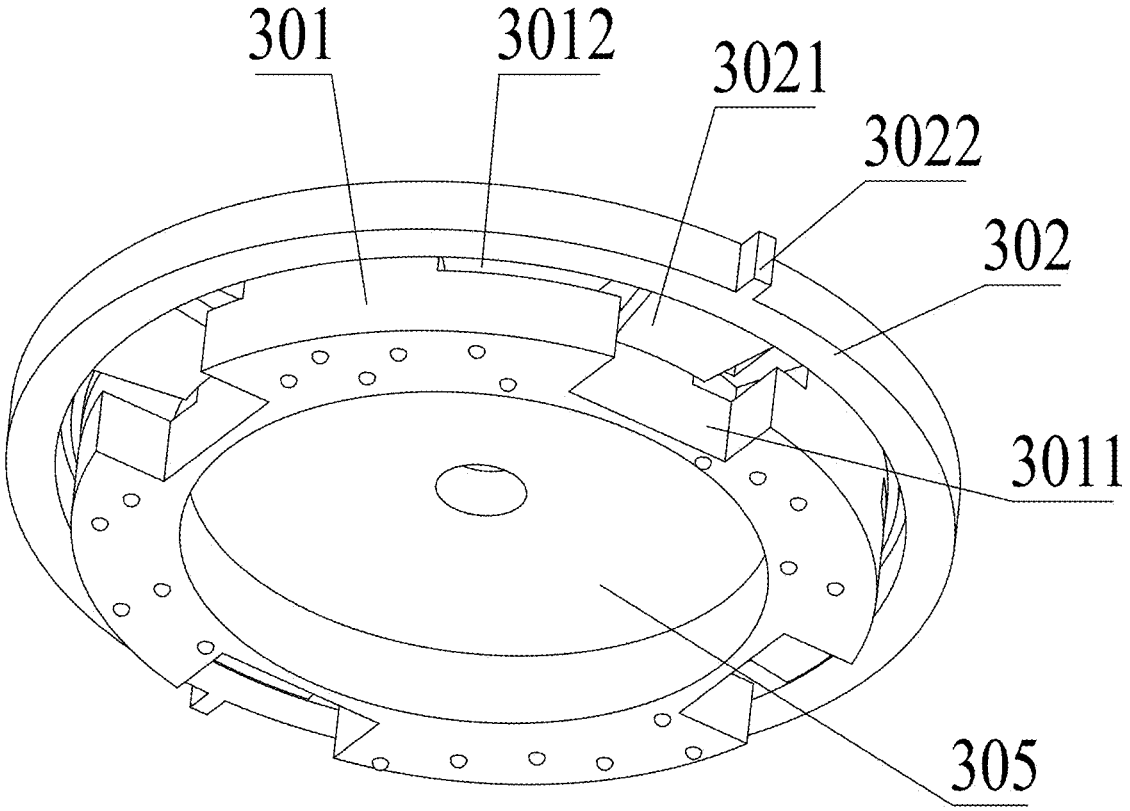
FIG. 5 is a schematic diagram of an internal structure of a leg pad in the present disclosure.
Figure 6:
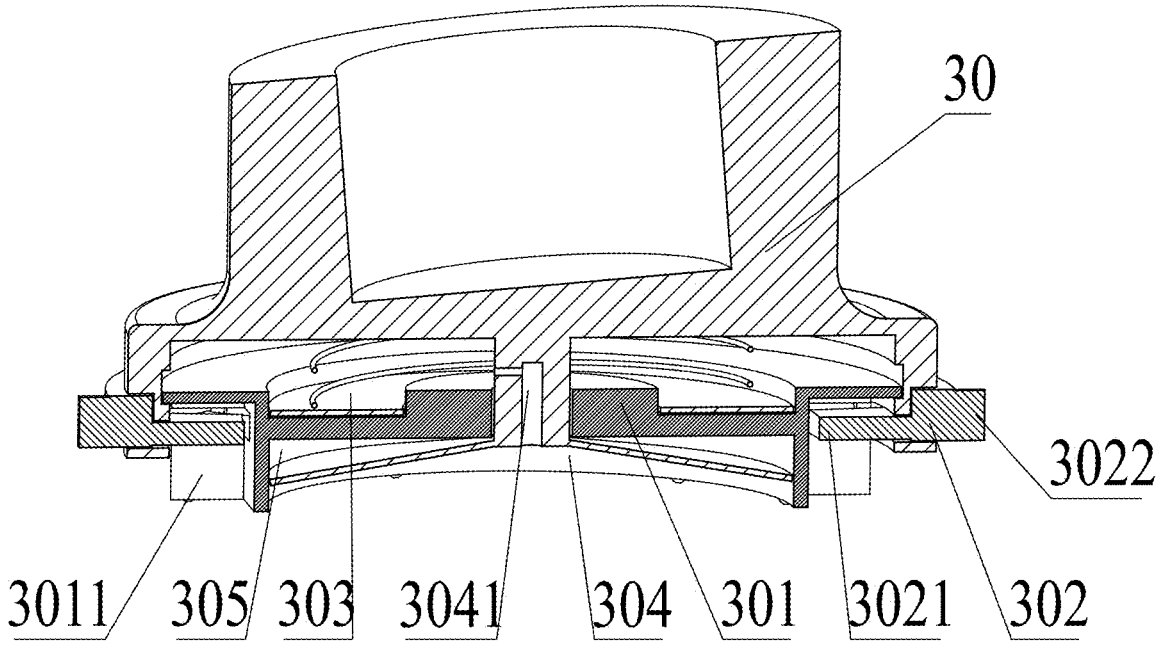
FIG. 6 is a schematic diagram of a half sectional structure of a leg pad in the present disclosure.

As shown in FIGS. 4 to 6, on the basis of Embodiment 1, a movable friction pad 301 capable of sliding is further disposed at the bottom of the leg pad 30, an auxiliary plate 303 is rotatably connected in the movable friction pad 301 and is connected in the leg pad 30 via an abutting spring, a suction cup 304 is further fixed in the middle of the leg pad 30, the movable friction pad 301 slides on the suction cup 304, a snap ring 302 is further disposed on an outer peripheral side of the movable friction pad 301 and rotates in the leg pad 30, inner grooves 3011 and limiting grooves 3012 are formed on the outer peripheral side of the movable friction pad 301, at least two limiting blocks 3021 and shifting plates 3022 are disposed on arc surfaces on two sides of the snap ring 302, the shifting plates 3022 are located outside the leg pad 30, the limiting blocks 3021 are located in the inner grooves 3011, a protective groove 305 is formed in the middle of the movable friction pad 301, a part of the bottom of the suction cup 304 is configured as a circular truncated cone, the circular truncated cone part is located in the protective groove 305, and a balance hole 3041 is further formed in the suction cup 304. Through the arrangement of the movable friction pads 301 and the suction cups 304, when a pressure is applied to the chair, the movable friction pads 301 are driven to press the abutting springs to move upward, such that the movable friction pads 301 block outlets of the balance holes 3041 to expose the suction cups 304; and then the suction cups 304 expel internal air under the pressure to form a negative pressure state, such that the leg pads 30 can adhere tightly to the smooth ground, thereby enhancing chair stability, and reducing the risk of the user falling over.

The snap ring 302 can also be rotated to snap the limiting blocks 3021 into the limiting grooves 3012, thereby restricting movement of the movable friction pad 301. In this case, only the bottom of the movable friction pad 301 provides non-slippage and support, allowing the chair to be used on the rough ground. Therefore, the snap rings 302 can be used to adjust the usage environment of the chair: when the movable friction pads 301 are used for support, the chair can be used on the rough ground, and when the protective grooves 305 are used for adhesion, the chair can be used on the smooth ground, thereby enhancing its applicability.

The working principle is as follows: when the usage environment is a smooth surface such as a bathroom, the limiting blocks 3021 can be adjusted to be in the inner grooves 3011. After the chair is properly placed, its own weight causes the movable friction pads 301 to enter the leg pads 30, and the suction cups 304 are exposed. In this case, when the user sits on the chair and applies a pressure, the suction cups 304 expel air, and the movable friction pads 301 block the balance holes 3041, such that the suction cups 304 adhere to the ground. In this case, even when the user is in an inclined state such as leaning forward or lying back, the risk of falling is reduced. If the user wants to pick up the chair, it is necessary to lift up the chair. Under the action of the abutting springs, the movable friction pads 301 move downward to open small holes at the balance holes 3041. In this case, the air pressure gradually returns to normal, and the suction cups 304 can no longer adhere, allowing the chair to be moved and placed elsewhere.

When the usage environment is the rough ground, the snap ring 302 can be rotated by the shifting plates 3022, such that the limiting blocks 3021 enter the limiting grooves 3012 to lock the movable friction pads 301. When the user sits on the chair, the movable friction pads 301 do not move, and the rough ground does not come into contact with the suction cups 304, thus protecting the chair, and preventing any impact on its performance. In this case, only the movable friction pads 301 provide support.

Embodiment 3

Figure 7:
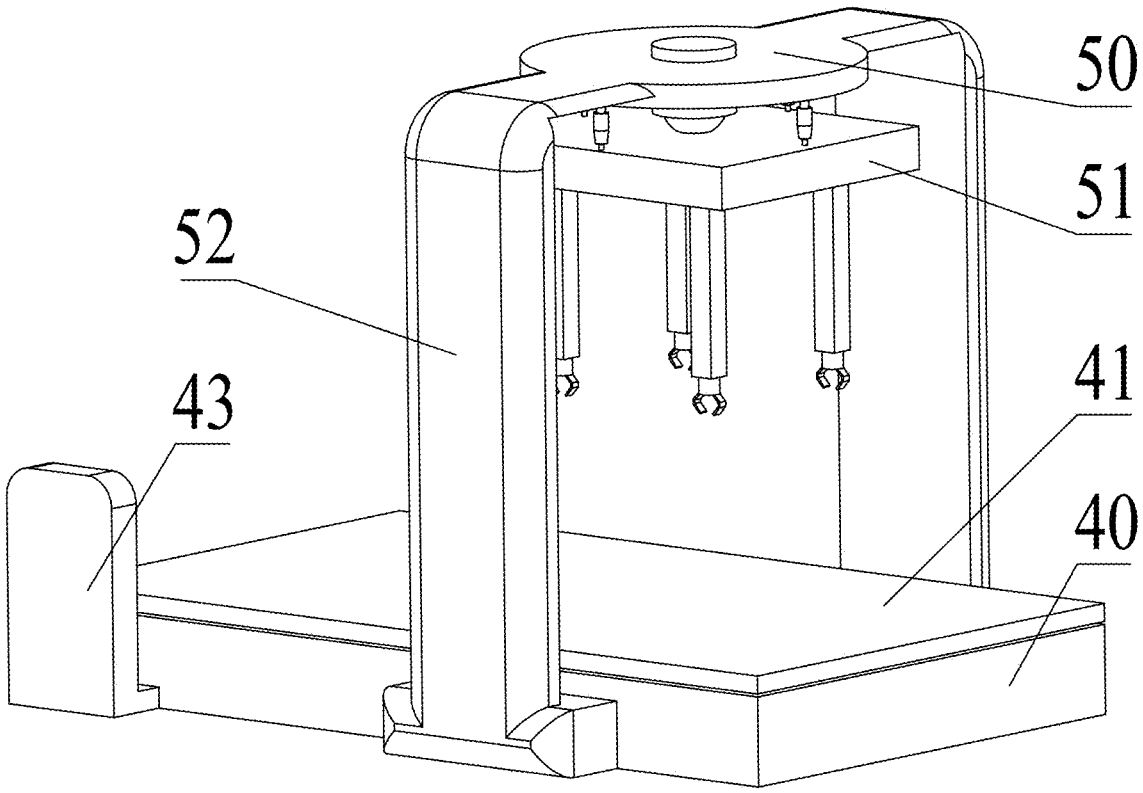
FIG. 7 is a schematic structural diagram of a detection device in the present disclosure.
Figure 8:
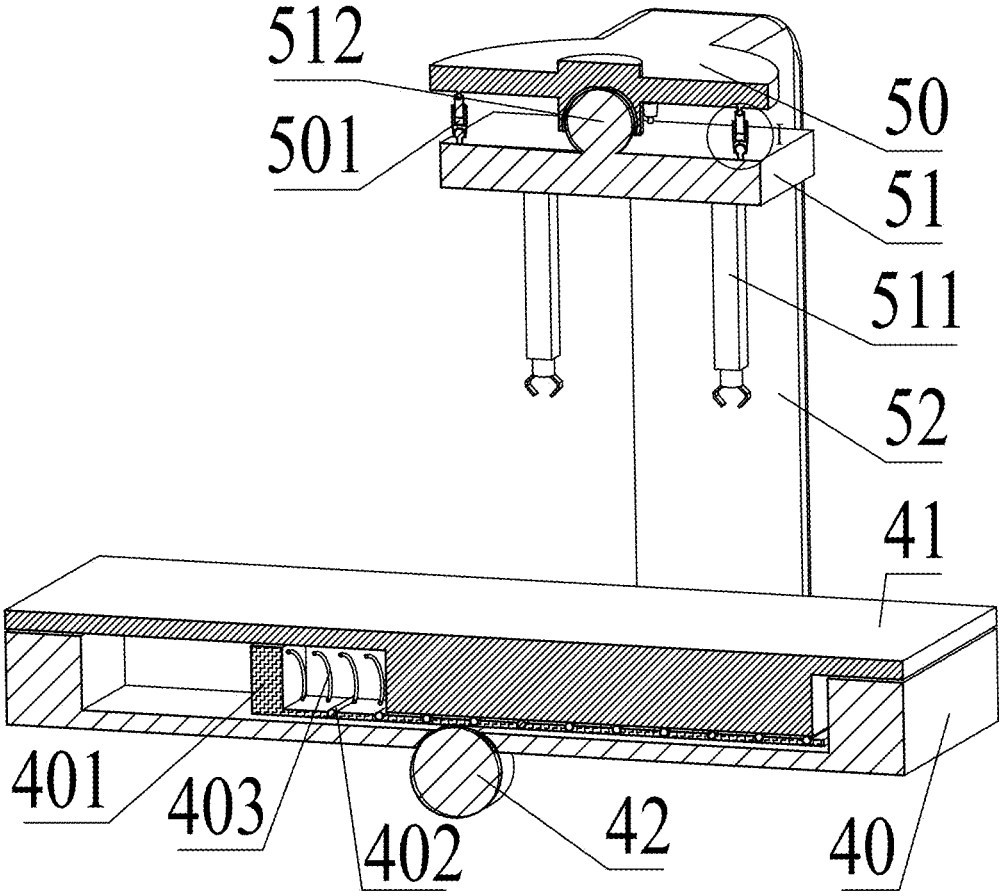
FIG. 8 is a schematic diagram of a half sectional structure of a detection device in the present disclosure.
Figure 9:
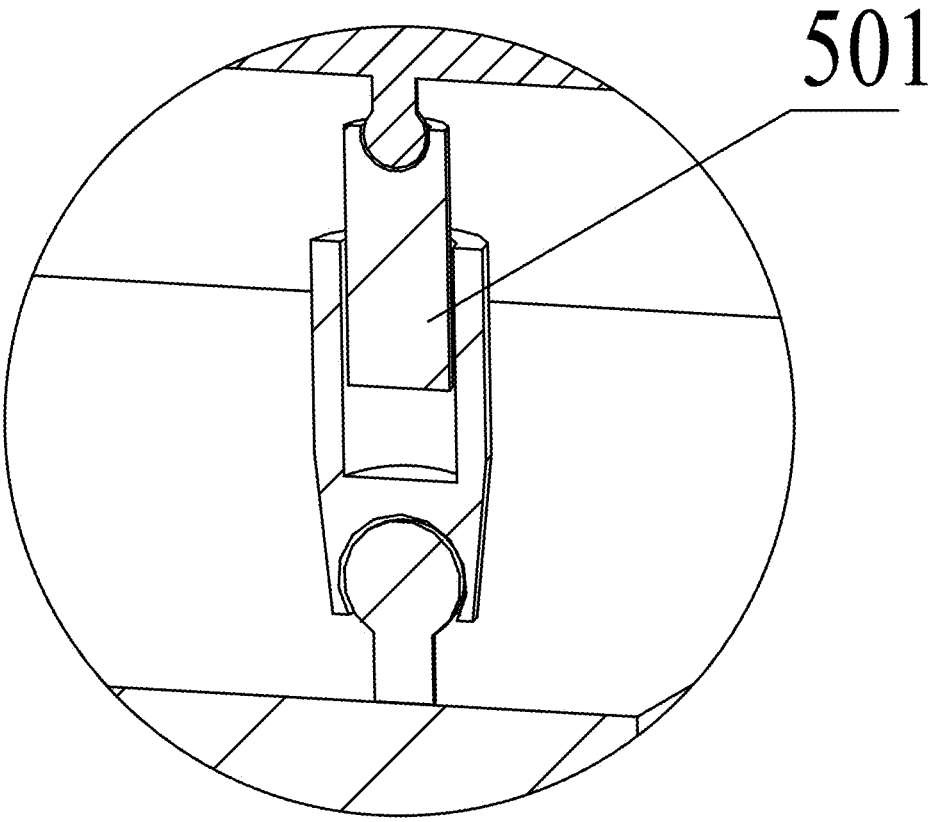
FIG. 9 is a schematic structural diagram of an electric cylinder in the present disclosure.

As shown in FIGS. 7 to 9, a non-slip detection device for a non-slip plastic chair includes a detection base 40 and a support disc 50, where a shifting assembly is disposed in the detection base 40, an operating platform 43 is disposed on an edge of one side of the detection base 40, a control module is disposed on the operating platform 43, and a pressure assembly is disposed on the support disc 50.

The shifting assembly includes a detection sliding block 401 and a pressure plate 41, where the pressure plate 41 is mounted in the detection sliding block 401 via a detection spring 403, and the detection sliding block 401 is slidably connected in the detection base 40; and a gear 42 is rotatably connected to the bottom of the detection base 40 and meshes with the detection sliding block 401, a motor is connected to the gear 42, several rotating roller shafts 402 are disposed at the bottom of the detection sliding block 401, and the pressure plate 41 abuts against the roller shafts 402. Through the arrangement of the roller shafts 402, sliding friction between the pressure plate 41 and the detection sliding block 401 can be converted into rolling friction, thus greatly reducing the influence of a frictional force between the pressure plate and the detection sliding block on a test result. The gear 42 rotates to drive the detection sliding block 401 to slide in the detection base 40. In this case, since the chair abuts against the pressure plate 41 and the support disc 50 applies a certain pressure, the pressure plate 41 does not slide. The gear 42 continues rotating to drive the detection sliding block 401 to slide, such that the detection spring 403 can be gradually stretched to increase a pulling force. When the pulling force of the detection spring is greater than a frictional force between the pressure plate 41 and the chair, the pressure plate 41 slides. In this case, the maximum pulling force generated by the detection spring 403 is a frictional force of the chair under a certain pressure, which is recorded and displayed via the operating platform 43.

The pressure assembly includes a pressure plate 51 and electric cylinders 501. The pressure plate 51 is mounted on the support disc 50 via a limiting ball 512. The limiting ball 512 is configured as a spherical body. There are at least two electric cylinders 501 mounted at edges of the support disc 50 respectively. Two sides of each of the electric cylinders 501 are connected to the support disc 50 and the pressure plate 51 via the spherical body. The support disc 50 is mounted on the detection base 40 via a telescopic plate 52, where the support disc 50 can move up and down via the telescopic plate 52. There are four electric cylinders 501 located at four edges of the pressure plate 51. Four clamping posts 511 are further movably disposed at the bottom of the pressure plate 51. The four chair legs of the chair can be clamped by the clamping posts 511 to limit their positions. Through the arrangement of the electric cylinders 501, the electric cylinders 501 can be intermittently activated, such that frictional forces of the chair in different pressure states can be detected. That is, if only the electric cylinder 501 on the right side is activated, the two corresponding clamping posts 511 exert a high pressure on the chair, while the other three sides of the chair are subjected to a low pressure. In this case, the pressure applied to the chair when the body of the user sitting on the chair leans can be simulated. The detection base 40 detects and records the pressure for comparison with individual detection results from the other three sides. In this way, multi-directional and multi-state detection can be performed on the chair, and frictional forces of the chair in different usage environments can be measured, thereby making performance detection of the chair more comprehensive.

In summary, according to the non-slip plastic chair and the non-slip detection device therefor, through the arrangement of the upper rotary table 11 and the lower rotary table 21, the chair is rotatable as a whole, which can improve user experience. The balls enable rolling friction between the upper rotary table 11 and the backrest 12, which not only serves to support the chair cover 10 and a heavy object thereon, but also can greatly reduce a frictional force between the upper rotary table 11 and the lower rotary table 21, thereby lowering noise generated when the chair rotates. Through the arrangement of the suction cups 304 and the movable friction pads 301, the suction cups 304 expel internal air under chair pressure to form a negative pressure state, such that the leg pads 30 can adhere tightly to the smooth ground, thereby enhancing chair stability, and reducing the risk of falling when the user is in an inclined state such as leaning forward or lying back. Through the arrangement of the pressure assembly and the shifting assembly, frictional forces of the chair in different pressure states can be detected. That is, if only the electric cylinder 501 on the right side is activated, the two corresponding clamping posts 511 exert a high pressure on the chair, while the other three sides of the chair are subjected to a low pressure. In this case, the pressure applied to the chair when the body of the user sitting on the chair leans can be simulated. The detection base 40 detects and records the pressure for comparison with individual detection results from the other three sides. In this way, multi-directional and multi-state detection can be performed on the chair, and frictional forces of the chair in different usage environments can be measured, thereby making performance detection of the chair more comprehensive.

It should be noted that herein, relational terms such as first and second are only used to distinguish one entity or operation from another, and do not necessarily require or imply that any such actual relationship or order exists between these entities or operations. Moreover, the terms "comprise" and "include" or any other variations thereof are intended to cover a non-exclusive inclusion, such that a process, method, article, or device including a series of elements not only includes those elements, but also includes other elements not expressly listed or inherent to such process, method, article, or device. Without further limitations, an element defined by the phrase "includes one . . . " does not exclude the presence of additional identical elements in the process, method, material, or device including the element.

Although embodiments of the present disclosure have been shown and described, it can be understood by those skilled in the art that various changes, modifications, substitutions, and variations can be made to these embodiments without departing from the principles and spirit of the present disclosure, and the scope of the present disclosure is defined by the appended claims and their equivalents.

What is claimed is:

1. A non-slip plastic chair, comprising a chair cover and a base plate, wherein the chair cover is movably connected to the base plate, at least two chair legs are disposed at a bottom of the base plate, and a leg pad is mounted at a bottom of each of the chair legs;

the leg pad is sleeved on the chair leg, and a non-slip member is disposed in the leg pad; and an upper rotary table is mounted in the chair cover, a lower rotary table is mounted in the base plate, and the upper rotary table is rotatably connected to the lower rotary table via balls;

wherein the non-slip member comprises: a suction cup fixed within the leg pad; and a movable friction pad slidably disposed at a bottom of the leg pad;

wherein the movable friction pad comprises: an auxiliary plate rotatably connected therein; and an abutting spring connecting the auxiliary plate to the leg pad; and a snap ring disposed on an outer peripheral side of the movable friction pad and rotatably coupled to the leg pad.

2. The non-slip plastic chair according to claim 1, wherein two symmetrical support tubes are mounted on the chair cover, the support tubes are arranged in an L shape, one part of each of the support tubes is fixedly mounted on the upper rotary table, and the other part of the support tube is mounted with a backrest.

3. The non-slip plastic chair according to claim 1, wherein the chair legs are fixed to the bottom of the base plate, each of the chair legs comprises a main support leg and an auxiliary support leg which are telescopically connected to each other, and the leg pad is sleeved on the auxiliary support leg.

4. The non-slip plastic chair according to claim 1, wherein the bottom of the leg pad is configured as a flat surface, and the non-slip member further comprises a non-slip pad which is disposed at the flat surface and made of rubber.

5. The non-slip plastic chair according to claim 1, wherein inner grooves and limiting grooves are formed on the outer peripheral side of the movable friction pad, at least two limiting blocks and at least two shifting plates are disposed on are surfaces on two sides of the snap ring, the shifting plates are located outside the leg pad, and the limiting blocks are located in the inner grooves; and a protective groove is formed in the middle of the movable friction pad, a part of the bottom of the suction cup is configured as a circular truncated cone, the circular truncated cone part is located in the protective groove, and a balance hole is further formed in the suction cup.

* * * * *